US008864492B2

(12) United States Patent
Shi et al.

(10) Patent No.: US 8,864,492 B2
(45) Date of Patent: Oct. 21, 2014

(54) REVERSE FLOW COMBUSTOR DUCT ATTACHMENT

(75) Inventors: Jun Shi, Glastonbury, CT (US); David C. Jarmon, Kensington, CT (US); Lee A. Hoffman, Vernon, CT (US); David J. Bombara, New Hartford, CT (US); Shaoluo L. Butler, Manchester, CT (US); Lev A. Prociw, Johnston, IA (US); Aleksandar Kojovic, Oakville (CA)

(73) Assignees: United Technologies Corporation, Hartford, CT (US); Pratt & Whitney Canada Corp., Longueuil, Quebec (CA)

( * ) Notice: Subject to any disclaimer, the term of this patent is extended or adjusted under 35 U.S.C. 154(b) by 337 days.

(21) Appl. No.: 13/167,167

(22) Filed: Jun. 23, 2011

(65) Prior Publication Data

US 2012/0328996 A1 Dec. 27, 2012

(51) Int. Cl.

| | |
|---|---|
| ***F23Q 2/32*** | (2006.01) |
| ***F23R 3/54*** | (2006.01) |
| ***F23R 3/60*** | (2006.01) |
| ***F23R 3/00*** | (2006.01) |

(52) U.S. Cl.

CPC ... *F23R 3/54* (2013.01); *F23R 3/60* (2013.01); *F23R 3/007* (2013.01)

USPC ..... 431/253; 60/226.2

(58) Field of Classification Search

USPC ..... 60/772, 752, 760, 800; 431/253

See application file for complete search history.

(56) References Cited

U.S. PATENT DOCUMENTS

| | | | | |
|---|---|---|---|---|
| 3,691,766 | A * | 9/1972 | Champion | 60/39.826 |
| 3,745,766 | A * | 7/1973 | Melconian | 60/39.23 |
| 3,869,864 | A * | 3/1975 | Bunn | 60/757 |
| 3,887,299 | A | 6/1975 | Profant | |
| 3,952,504 | A | 4/1976 | Sedgwick | |
| 4,008,978 | A | 2/1977 | Smale | |
| 4,171,614 | A * | 10/1979 | Weiler | 60/804 |
| 4,363,208 | A | 12/1982 | Hoffman et al. | |
| 4,398,866 | A | 8/1983 | Hartel et al. | |
| 4,411,594 | A * | 10/1983 | Pellow et al. | 415/173.3 |
| 4,549,402 | A * | 10/1985 | Saintsbury et al. | 60/738 |
| 4,573,320 | A | 3/1986 | Kralick | |

(Continued)

FOREIGN PATENT DOCUMENTS

| | | |
|---|---|---|
| GB | 2250782 A | 6/1992 |
| WO | 2010146288 A1 | 12/2010 |

OTHER PUBLICATIONS

Characterization of First-Stage Silicon Nitride Components After Exposure to an Industrial Gas Turbine H.-T. Lin,*,M. K. Ferber,* and P. F. Becher, J. R. Price, M. van Roode, J. B. Kimmel, and O. D. Jimenez J. Am. Ceram. Soc., 89 [1] 258-265 (2006).

(Continued)

*Primary Examiner* — Avinash Savani

*Assistant Examiner* — George R Blum

(74) *Attorney, Agent, or Firm* — Bachman & LaPointe, P.C.

(57) ABSTRACT

A reverse flow combustor has an inlet end. A flowpath extends downstream from the inlet end through a turn. The turn directs the flowpath radially inward and reversing an axial flow direction. A large exit duct (LED) is along the turn. A small exit duct (SED) is along the turn and joined by a joint to a mounting structure to resist separation in a first axial direction. The joint comprises: a first surface on the SED facing partially radially inward; and a mounting feature engaging the first surface.

12 Claims, 9 Drawing Sheets

(56) References Cited

U.S. PATENT DOCUMENTS

| | | | | |
|---|---|---|---|---|
| 4,594,848 | A * | 6/1986 | Mongia et al. | 60/772 |
| 4,626,461 | A | 12/1986 | Prewo et al. | |
| 4,759,687 | A | 7/1988 | Miraucourt et al. | |
| 4,909,708 | A * | 3/1990 | Albrecht | 415/208.1 |
| 5,092,737 | A | 3/1992 | Lau | |
| 5,237,813 | A * | 8/1993 | Harris et al. | 60/804 |
| 5,299,914 | A | 4/1994 | Schilling | |
| 5,392,596 | A | 2/1995 | Holsapple et al. | |
| 5,466,122 | A | 11/1995 | Charbonnel et al. | |
| 5,579,645 | A * | 12/1996 | Prociw et al. | 60/740 |
| 6,042,315 | A | 3/2000 | Miller et al. | |
| 6,045,310 | A | 4/2000 | Miller et al. | |
| 6,182,436 | B1 * | 2/2001 | Prociw et al. | 60/776 |
| 6,197,424 | B1 | 3/2001 | Morrison et al. | |
| 6,200,092 | B1 | 3/2001 | Koschier | |
| 6,241,471 | B1 | 6/2001 | Herron | |
| 6,250,883 | B1 | 6/2001 | Robinson et al. | |
| 6,269,628 | B1 * | 8/2001 | Gates | 60/804 |
| 6,325,593 | B1 | 12/2001 | Darkins, Jr. et al. | |
| 6,397,603 | B1 | 6/2002 | Edmondson et al. | |
| 6,451,416 | B1 | 9/2002 | Holowczak et al. | |
| 6,514,046 | B1 | 2/2003 | Morrison et al. | |
| 6,648,597 | B1 | 11/2003 | Widrig et al. | |
| 6,676,373 | B2 | 1/2004 | Marlin et al. | |
| 6,696,144 | B2 | 2/2004 | Holowczak et al. | |
| 6,709,230 | B2 | 3/2004 | Morrison et al. | |
| 6,733,233 | B2 * | 5/2004 | Jasklowski et al. | 415/135 |
| 6,746,755 | B2 | 6/2004 | Morrison et al. | |
| 6,758,386 | B2 | 7/2004 | Marshall et al. | |
| 6,758,653 | B2 | 7/2004 | Morrison | |
| 6,808,363 | B2 | 10/2004 | Darkins, Jr. et al. | |
| 6,810,672 | B2 * | 11/2004 | Coutandin | 60/752 |
| 6,854,738 | B2 | 2/2005 | Matsuda et al. | |
| 6,893,214 | B2 | 5/2005 | Alford et al. | |
| 6,910,853 | B2 | 6/2005 | Corman et al. | |
| 6,935,836 | B2 | 8/2005 | Ress, Jr. et al. | |
| 7,090,459 | B2 | 8/2006 | Bhate et al. | |
| 7,093,359 | B2 | 8/2006 | Morrison et al. | |
| 7,094,027 | B2 | 8/2006 | Turner et al. | |
| 7,114,917 | B2 | 10/2006 | Legg | |
| 7,117,983 | B2 | 10/2006 | Good et al. | |
| 7,153,096 | B2 | 12/2006 | Thompson et al. | |
| 7,185,432 | B2 * | 3/2007 | Swaffar | 29/889.1 |
| 7,198,454 | B2 | 4/2007 | Evans | |
| 7,198,458 | B2 | 4/2007 | Thompson | |
| 7,247,003 | B2 | 7/2007 | Burke et al. | |
| 7,269,958 | B2 * | 9/2007 | Stastny et al. | 60/804 |
| 7,278,830 | B2 | 10/2007 | Vetters | |
| 7,384,240 | B2 | 6/2008 | McMillan et al. | |
| 7,434,670 | B2 | 10/2008 | Good et al. | |
| 7,435,058 | B2 | 10/2008 | Campbell et al. | |
| 7,452,182 | B2 | 11/2008 | Vance et al. | |
| 7,452,189 | B2 | 11/2008 | Shi et al. | |
| 7,488,157 | B2 | 2/2009 | Marini et al. | |
| 7,491,032 | B1 | 2/2009 | Powell et al. | |
| 7,497,662 | B2 | 3/2009 | Mollmann et al. | |
| 7,510,379 | B2 | 3/2009 | Marusko et al. | |
| 7,534,086 | B2 | 5/2009 | Mazzola et al. | |
| 7,546,743 | B2 | 6/2009 | Bulman et al. | |
| 7,600,970 | B2 | 10/2009 | Bhate et al. | |
| 7,647,779 | B2 | 1/2010 | Shi et al. | |
| 7,648,336 | B2 | 1/2010 | Cairo | |
| 7,665,960 | B2 | 2/2010 | Shi et al. | |
| 7,726,936 | B2 | 6/2010 | Keller et al. | |
| 7,753,643 | B2 | 7/2010 | Gonzalez et al. | |
| 7,762,768 | B2 | 7/2010 | Shi et al. | |
| 7,771,160 | B2 * | 8/2010 | Shi et al. | 415/138 |
| 7,785,076 | B2 | 8/2010 | Morrison et al. | |
| 7,824,152 | B2 | 11/2010 | Morrison | |
| 7,954,326 | B2 * | 6/2011 | Lai et al. | 60/752 |
| 8,438,855 | B2 * | 5/2013 | Schott | 60/751 |
| 2002/0162331 | A1 * | 11/2002 | Coutandin | 60/752 |
| 2004/0074239 | A1 * | 4/2004 | Tiemann | 60/798 |
| 2005/0005610 | A1 * | 1/2005 | Belsom et al. | 60/796 |
| 2005/0158171 | A1 | 7/2005 | Carper et al. | |
| 2005/0254942 | A1 | 11/2005 | Morrison et al. | |
| 2007/0072007 | A1 | 3/2007 | Carper et al. | |
| 2007/0175029 | A1 * | 8/2007 | Locatelli et al. | 29/888.01 |
| 2007/0227119 | A1 * | 10/2007 | Alkabie | 60/249 |
| 2007/0227150 | A1 * | 10/2007 | Alkabie et al. | 60/754 |
| 2007/0234726 | A1 * | 10/2007 | Patel et al. | 60/752 |
| 2007/0234727 | A1 * | 10/2007 | Patel et al. | 60/754 |
| 2007/0245710 | A1 * | 10/2007 | Schumacher et al. | 60/226.1 |
| 2008/0034759 | A1 | 2/2008 | Bulman et al. | |
| 2009/0133404 | A1 * | 5/2009 | Lai et al. | 60/754 |
| 2010/0021290 | A1 | 1/2010 | Schaff et al. | |
| 2010/0032875 | A1 | 2/2010 | Merrill et al. | |
| 2010/0111678 | A1 | 5/2010 | Habarou et al. | |
| 2010/0111682 | A1 * | 5/2010 | Scoggins et al. | 415/191 |
| 2010/0226760 | A1 | 9/2010 | Mccaffrey | |
| 2010/0247298 | A1 * | 9/2010 | Nakamura et al. | 415/173.1 |
| 2010/0257864 | A1 * | 10/2010 | Prociw et al. | 60/758 |
| 2011/0008156 | A1 * | 1/2011 | Prentice et al. | 415/200 |
| 2011/0023499 | A1 * | 2/2011 | Grivas et al. | 60/796 |
| 2011/0027098 | A1 | 2/2011 | Noe et al. | |
| 2011/0052384 | A1 | 3/2011 | Shi et al. | |
| 2012/0328366 | A1 * | 12/2012 | Jarmon et al. | 403/376 |

OTHER PUBLICATIONS

Evaluation of Mechanical Stability of a Commercial Sn88 Silicon Nitride at Intermediate Temperatures Hua-Tay Lin,* Mattison K. Ferber,* and Timothy P. Kirkland*, J. Am. Ceram. Soc., 86 [7] 1176-81 (2003).

Research and Development of Ceramic Turbine Wheels, K. Watanab, M. Masuda T. Ozawa, M. Matsui, K. Matsuhiro, 36 I vol. 115, Jan. 1993, Transactions of the ASME.

A.L. Neuburger and G. Carrier, Design and Test of Non-rotating Ceramic Gas Turbine Components, ASME Turbo Expo 1988, ASME paper 88-GT-146.

Vedula, V., Shi, J., Liu, S., and Jarmon, D. "Sector Rig Test of a Ceramic Matrix Composite (CMC) Combustor Liner", GT2006-90341, Proceedings of GT2006, ASME Turbo Expo 2006: Power for Land, Sea and Air, Barcelona, Spain, May 8-11, 2006.

Bhatia, T., "Enabling Technologies for Hot Section Components", Contract N00014-06-C-0585, Final Report, Jan. 30, 2009.

Vedula, V., et al., "Ceramic Matrix Composite Turbine Vanes for Gas Turbine Engines", ASME Paper GT2005-68229, Proceedings of ASME Turbo Expo 2005, Reno, Nevada, Jun. 6-9, 2005.

Verrilli, M., Calamino, A., Robinson, R.C., and Thomas, D.J., "Ceramic Matrix Composite Vane Subelement Testing in a Gas Turbine Environment", Proceedings of ASME Turbo Expo 2004, Power for Land, Sea, and Air, Jun. 14-17, 2004, Vienna, ASME Paper GT2004-53970.

Watanbe, K., Suzumura, N., Nakamura, T., Murata, H., Araki, T., and Natsumura, T., "Development of CMC Vane for Gas Turbine Engine", Ceramic Engineering and Science Proceedings, vol. 24, Issue 4, 2003, pp. 599-604.

Calamino, A. and Verrilli, M., "Ceramic Matrix Composite Vane Subelement Fabrication", Proceedings of ASME Turbo Expo 2004, Power for Land, Sea, and Air, Jun. 14-17, 2004, Vienna, ASME Paper GT2004-53974.

Bhatia, T., et al., "CMC Combustor Line Demonstration in a Small Helicopter Engine", ASME Turbo Expo 2010, Glasgow, UK, Jun. 14-18, 2010.

European Search Report for EP Patent Application No. 12172767.1, dated Dec. 16, 2013.

* cited by examiner

REVERSE FLOW COMBUSTOR DUCT ATTACHMENT

BACKGROUND

The disclosure relates to gas turbine engines. More particularly, the disclosure relates to attaching ceramic matrix composite (CMC) ducts in reverse flow combustors.

Ceramic matrix composite (CMC) materials have been proposed for various uses in high temperature regions of gas turbine engines. US Pregrant Publication 2010/0257864 of Prociw et al. (the disclosure of which is incorporated herein in its entirety as if set forth at length) discloses use in duct portions of an annular reverse flow combustor. The annular reverse flow combustor turns the flow by approximately 180 degrees from an upstream portion of the combustor to the inlet of the turbine section. Viewed in axial/radial section, an inlet dome exists at the upstream end of the combustor. Additionally, an outboard portion of the turn is formed by an annular wall known as large exit duct (LED) and an inboard portion of the turn is formed by an annular wall known as a small exit duct (SED). The LED and SED may be formed of CMC. The CMC may be secured to adjacent metallic support structure (e.g., engine case structure). The SED and LED are alternatively referred to via the same acronyms but different names with various combinations of "short" replacing "small", "long" replacing "large", and "entry" replacing "exit" (this last change representing the point of view of the turbine rather than the point of view of the upstream portion of the combustor). An outer air inlet ring is positioned between the LED and the OD of the inlet dome. An inner air inlet ring is positioned between the SED and the ID of the inlet dome.

Robustly and efficiently attaching a CMC to the metal presents engineering challenges.

SUMMARY

One aspect of the disclosure involves a reverse flow combustor having an inlet end. A flowpath extends downstream from the inlet end through a turn. The turn directs the flowpath radially inward and reversing an axial flow direction. A large exit duct (LED) is along the turn. A small exit duct (SED) is along the turn and joined by a joint to a mounting structure to resist separation in a first axial direction. The joint comprises: a first surface on the SED facing partially radially inward; and a mounting feature engaging the first surface.

In various implementations, the SED may comprise a thickened upstream region. The first surface may be a shoulder formed by the thickened upstream region.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
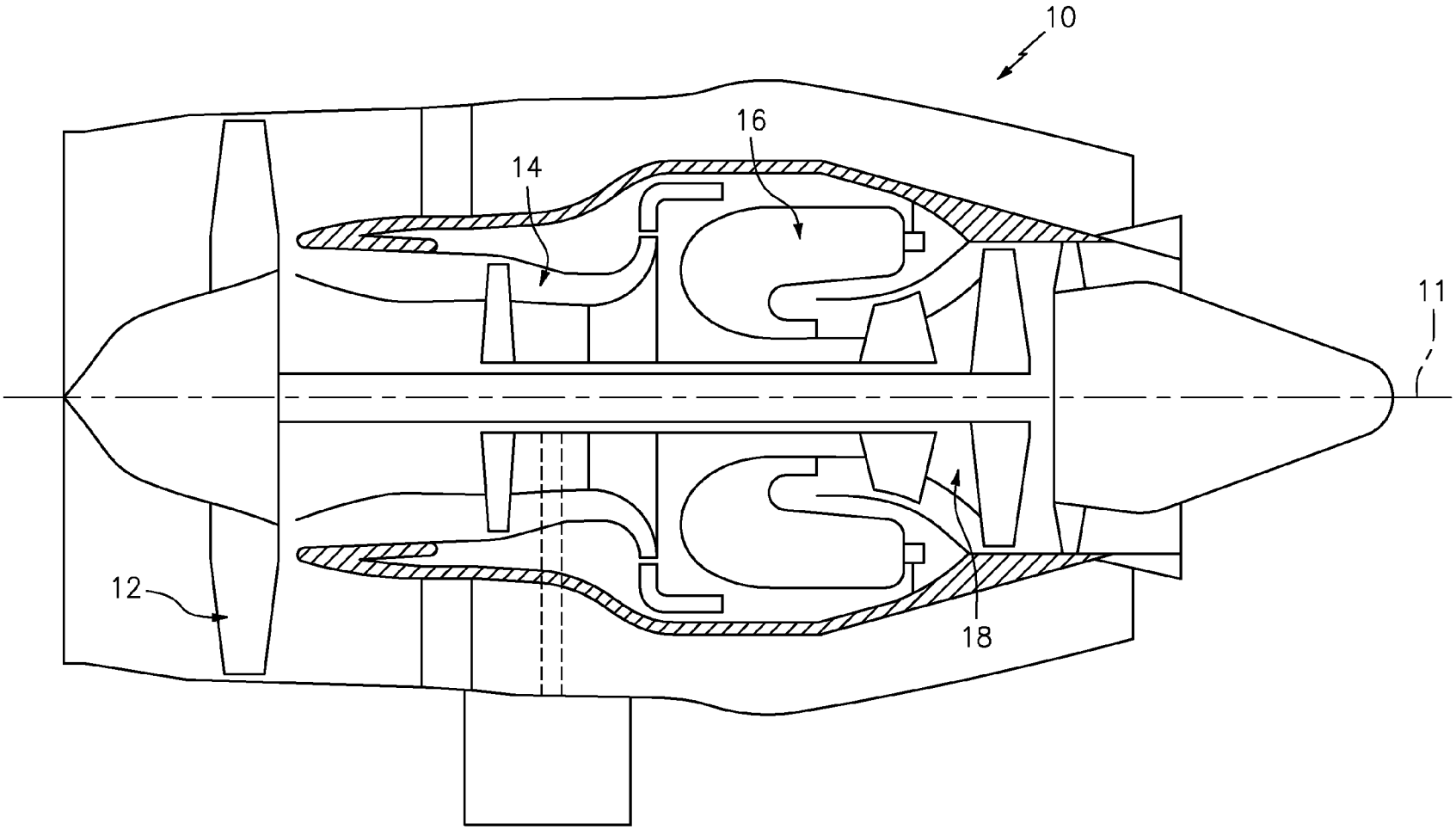
FIG. 1 is a partially schematic axial sectional/cutaway view of a gas turbine engine.

FIG. 1 shows a gas turbine engine 10 generally comprising in serial flow communication from upstream to downstream: a fan 12 through which ambient air is propelled; a multistage compressor 14 for pressurizing the air; an annular reverse flow combustor 16 in which the compressed air is mixed with fuel and ignited for generating an annular stream of hot combustion gases; and a turbine section 18 for extracting energy from the combustion gases.

The terms axial and radial as used herein are intended to be defined relative to the main central longitudinally extending engine axis 11 (centerline). Further, when referring to the combustor 16 herein, the terms upstream and downstream and intended to be defined relative to the general flow of air and hot combustion gases in the combustor, i.e. from a fuel nozzle end of the combustor where fuel and air are injected for ignition to a combustor exit where the combustion gases exit toward the downstream first turbine stage.

Figure 2:
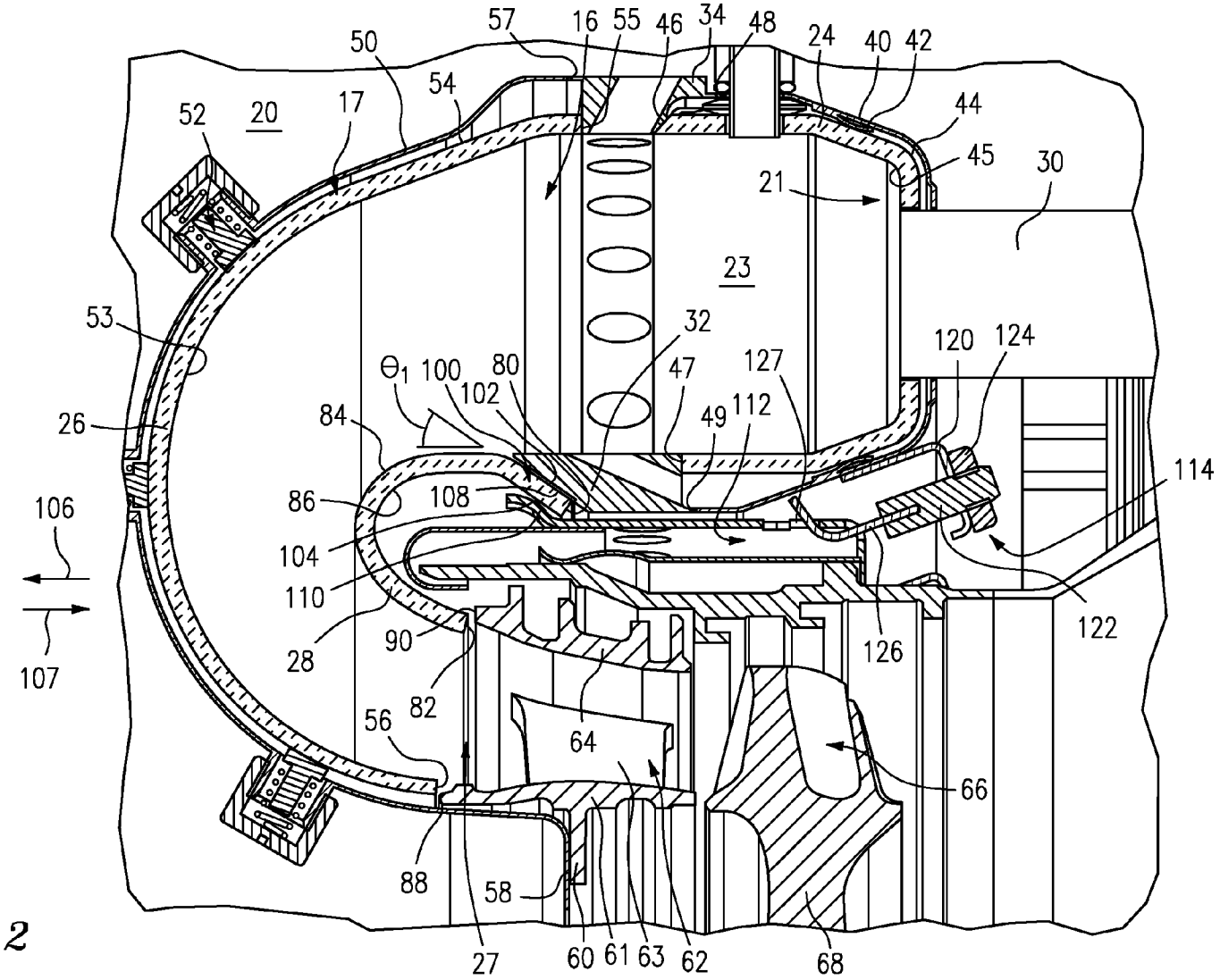
FIG. 2 is an axial/radial sectional view of a combustor of the engine of FIG. 1.

Referring to FIG. 2, the annular reverse flow combustor 16 comprises generally an inner combustor liner 17, directly exposed to and facing the combustion chamber 23 defined therewithin. The inner liner 17 of the combustor 16 is thus exposed to the highest temperatures, being directly exposed to the combustion chamber 23. As such, and as will be described in further detail below, the inner liner 17 is composed of at least one liner portion that is made of a non-metallic high temperature material such as a ceramic matrix composite (CMC) material. Such a CMC liner portion is much better able to withstand high temperatures with little or no cooling in comparison with standard metallic combustor liners. An air plenum 20, which surrounds the combustor 16, receives compressed air from the compressor section 14 of the gas turbine engine 10 (see FIG. 1). This compressed air is fed into the combustion chamber 23, however as will be described further below, exemplary CMC liner portions of the combustor 16 are substantially free of airflow passages (e.g., cooling holes) extending therethrough. This greatly simplifies their production, as no additional machining steps (such as drilling of cooling holes) are required once the CMC liner portions are formed. As such, the compressed air from the plenum 20 is, in at least this embodiment, fed into the combustion chamber 23 via air holes defined in metallic ring portions 32, 34 (e.g., high temperature nickel-based superalloys with thermal barrier coatings) of the combustor liner, as will be described further below. Metered air flow can also be fed into the combustion chamber via the fuel nozzles 30.

The inner liner 17 extends from an upstream end 21 of the combustor 16 (where a plurality of fuel nozzles 30, which communicate with the combustion chamber 23 to inject fuel therein, are located) to a downstream end (relative to gas flow in the combustion chamber) defining the combustor exit 27. The inner liner 17 is, in at least one embodiment, comprised of the main liner portions, namely a dome portion (inlet dome) 24 at the upstream end (inlet end) 21 of the combustor, and a long exit duct portion 26 and a short exit duct portion 28 which together form the combustor exit 27 at their respective downstream ends. Each of the dome portion 24, long exit duct portion 26 and short exit duct portion 28, that are made of the CMC material and which make up a substantial part of the inner liner 17, have a substantially hemi-toroidal shape and constitute an independently formed shell.

FIG. 2 shows a rich burn and quick quench combustor where the three CMC components 24, 26, 28 form the inner liner of combustor. The disclosure is primarily concerned with the attachment of CMC SED 28.

Although ceramic materials have excellent high temperature strength, their coefficients of thermal expansion (CTE) are much lower than those of metals such as the rings 32 and 34. Thermal stress arising from the mismatch of CTEs poses a challenge to the insertion of CMC combustor liner components into gas turbine engines. Exemplary joints thus allow relative movement between the CMC and its metal support structure(s), without introducing damaging thermal stresses.

The nature of the dome 24 and the LED 26 make them relatively easy to compliantly mount. In axial/radial section their exterior surfaces (away from the hot gas of the combustor interior) are generally convex. It is thus easy to compliantly compressively hold them in place. For example, the exemplary dome and LED are contained within respective shells 40 and 50 with compliant mounting members 42 and 52 respectively engaging the exterior surfaces 44 and 54 of the dome and SED. The exemplary shells 40 and 50 are metallic shells mounted to adjacent structure. The exemplary spring members 42 are half leaf spring tabs secured to the interior surface of the shell 40. The exemplary spring members 52 are more complex assemblies of pistons and coil springs with piston heads engaging the LED exterior surface 54.

The exemplary dome further includes an interior surface 45, an outboard rim 46, and an inboard rim 47. The exemplary liner section 40 also includes an outboard rim 48 and an inboard rim 49. The exemplary outboard rim 48 is secured to a mating surface of the outer air inlet ring (outer ring) 34 (e.g., via welding) and the exemplary inboard rim 49 is secured to the inner air inlet ring (inner ring) 32 such as via welding.

Similarly, the LED has an interior surface 53, upstream rim 55 and a downstream rim 56. The liner 50 includes an upstream portion (e.g., a rim) 57 and a downstream portion (e.g., a flange) 58. The exemplary rim 57 is secured to the outer ring 34 (e.g., via welding). The exemplary flange 58 is secured to a corresponding flange 60 of the platform ring (inner ring) 61 of an exit vane ring 62. The exemplary exit vane ring 62 includes a circumferential array of airfoils 63 extending from the platform 61 to a shroud ring (outer ring) 64.

The SED extends from an upstream rim 80 to a downstream rim 82 and has a generally convex interior surface 84 and a generally concave exterior surface 86. The LED downstream rim 56 and SED downstream rim 82 are proximate respective upstream rims 88 and 90 of the vane inner ring 61 and outer ring 64. The first blade stage of the first turbine section is downstream of the vane ring 62 with the blade airfoils 66 shown extending radially outward from a disk 68.

For mounting of the SED, a leading/upstream portion/region 100 of the SED is shown directed radially inwardly toward the upstream rim 80 (e.g., off-axial by an angle $\theta_1$). The exemplary SED is of generally constant thickness (e.g., subject to variations in local thickness associated with the imposed curvature of the cross-section of the SED in the vicinity of up to 20%). The inward direction of this portion 100 thus creates associated approximately frustoconical surface portions 102 and 104 of the surfaces 84 and 86 along the region 100. The surface portion 104 thus faces partially radially inward. The surface portion 104 may, thus, be engaged by an associated mounting feature to resist axial separation in a first axial direction 106 (forward in the exemplary engine wherein combustor inlet flow is generally forward). Movement in a second direction 107 opposite 106 is resisted by engagement of the surface portion 102 with a corresponding angled downstream surface 108 of the ring 32 (e.g., also at $\theta_1$). Exemplary $\theta_1$ are 20-60°, more narrowly, 30-50° or 35-45°). The SED may be retained against outward radial movement/displacement by engagement of the surface portion 102 with the downstream surface 108 and/or by hoop stress in the CMC. For example, alternative implementations may lack the surface 108 and thus rely entirely upon hoop stress to retain the SED against outward radial movement. An exemplary SED is formed of CMCs such as silicon carbide reinforced silicon carbide (SiC/SiC) or silicon (Si) melt infiltrated SiC/SiC (MI SiC/SiC). The CMC may be a substrate atop which there are one or more protective coating layers or adhered/secured to which there are additional structures. It may be formed with a sock weave fiber reinforcement including continuous hoop fibers.

Figure 3:
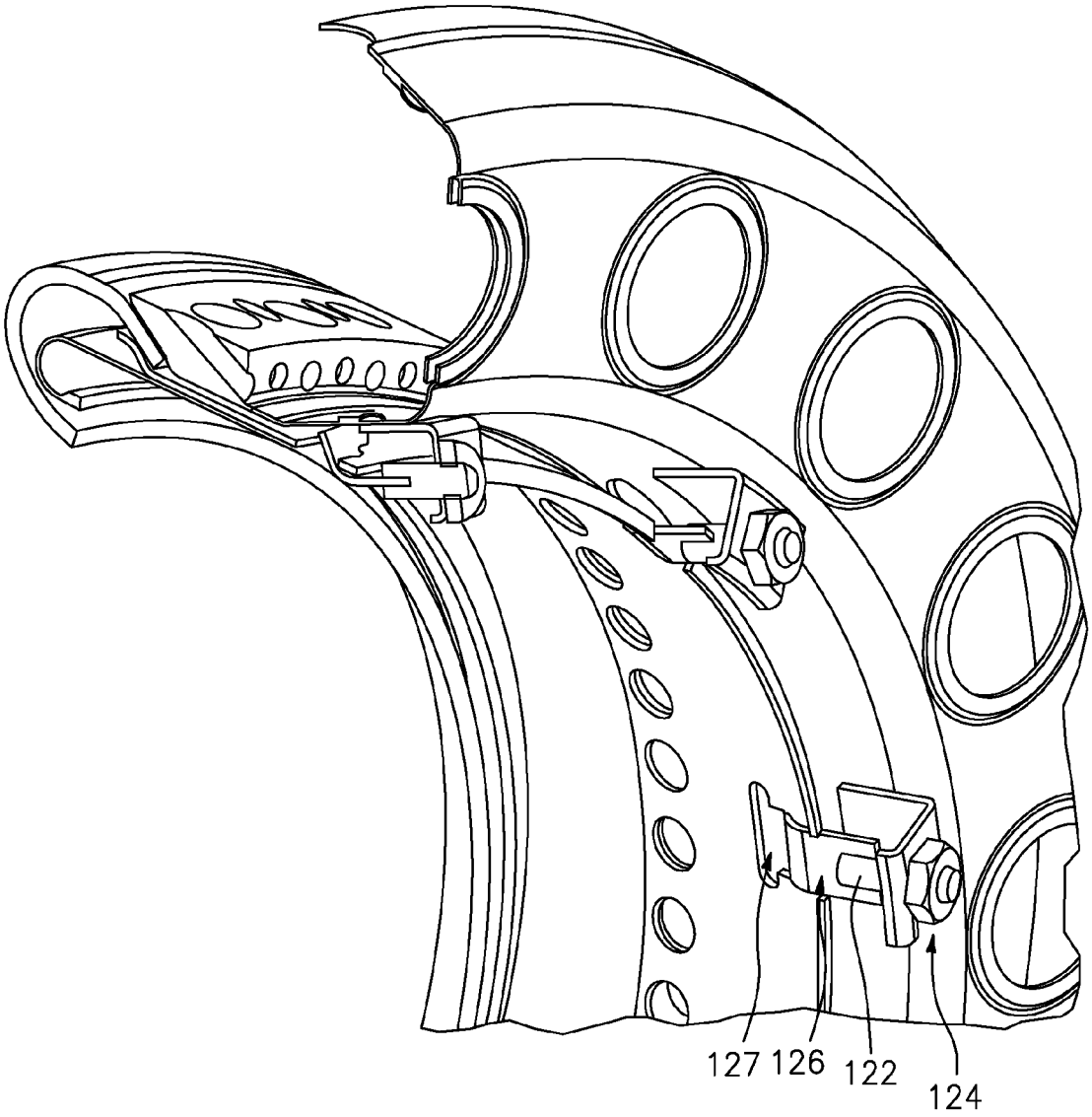
FIG. 3 is a partial cutaway view of the combustor of FIG. 2.

The exemplary mounting feature comprises a circumferential array of radially outwardly-projecting distal tabs 110 of a metallic clamp ring 112. The clamp ring is pulled axially in the direction 107 via an annular array of hook bolt assemblies 114. Exemplary hook bolt assemblies 114 are mounted to the dome shell 40. Exemplary hook bolt assemblies include a fixed base (support) 120 mounted to an inboard portion of the dome shell. A threaded shaft 122 extends through an aperture in the base 120 and is engaged by a nut 124 which may be turned (tightened) to draw the shaft at least partially axially in the direction 107. The shaft is coupled to a hook 126 (see also, FIG. 3) which engages a corresponding aperture 127 in the ring 112 to allow tightening of the nut to draw the ring in the direction 107. The combination of flexing of the tabs 110 with the angle of the region 100 and face 108 allows for differential thermal expansion with sliding engagement between the ring face 102 and the face 108. The clamp load can be controlled by the stiffness of the tabs 110, metal ring 112, and hook bolt supports 120.

In the exemplary mounting configuration, the gripping of the portion 100 is the only mounting of the SED with the downstream rim 82 being slightly spaced apart from adjacent structures.

Figure 4:
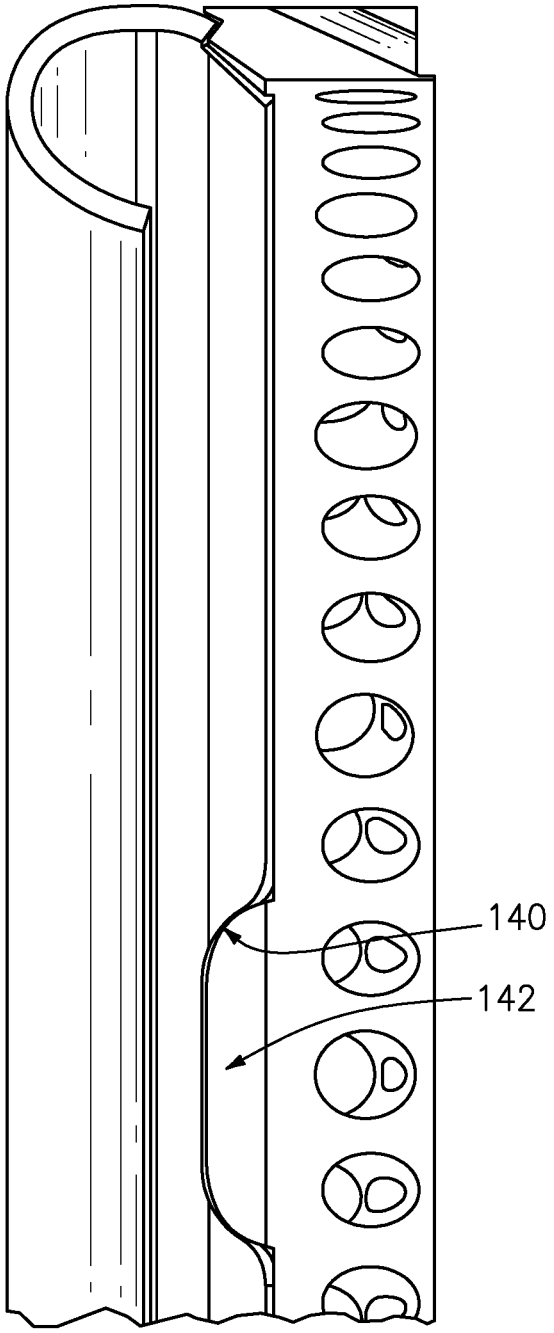
FIG. 4 is a partial radially outward cutaway view of a leading edge of an SED of the combustor of FIG. 2.

Rotational registration and retention of the SED to the ring 32 may also be provided. Exemplary rotational registration and retention means comprises a circumferential series of recesses 140 (FIG. 4) in the rim 80 and region 100. These recesses 140 cooperate with protruding portions 142 of the ring 32 (e.g., protruding from the main frustoconical portion of the surface 108). The exemplary recesses are through-recesses extending all the way between the surfaces 102 and 104. In alternative implementations, the recesses 140 and protruding portions 142 may be reversed with recesses appearing in the ring and protruding portions appearing on the SED.

Figure 5:
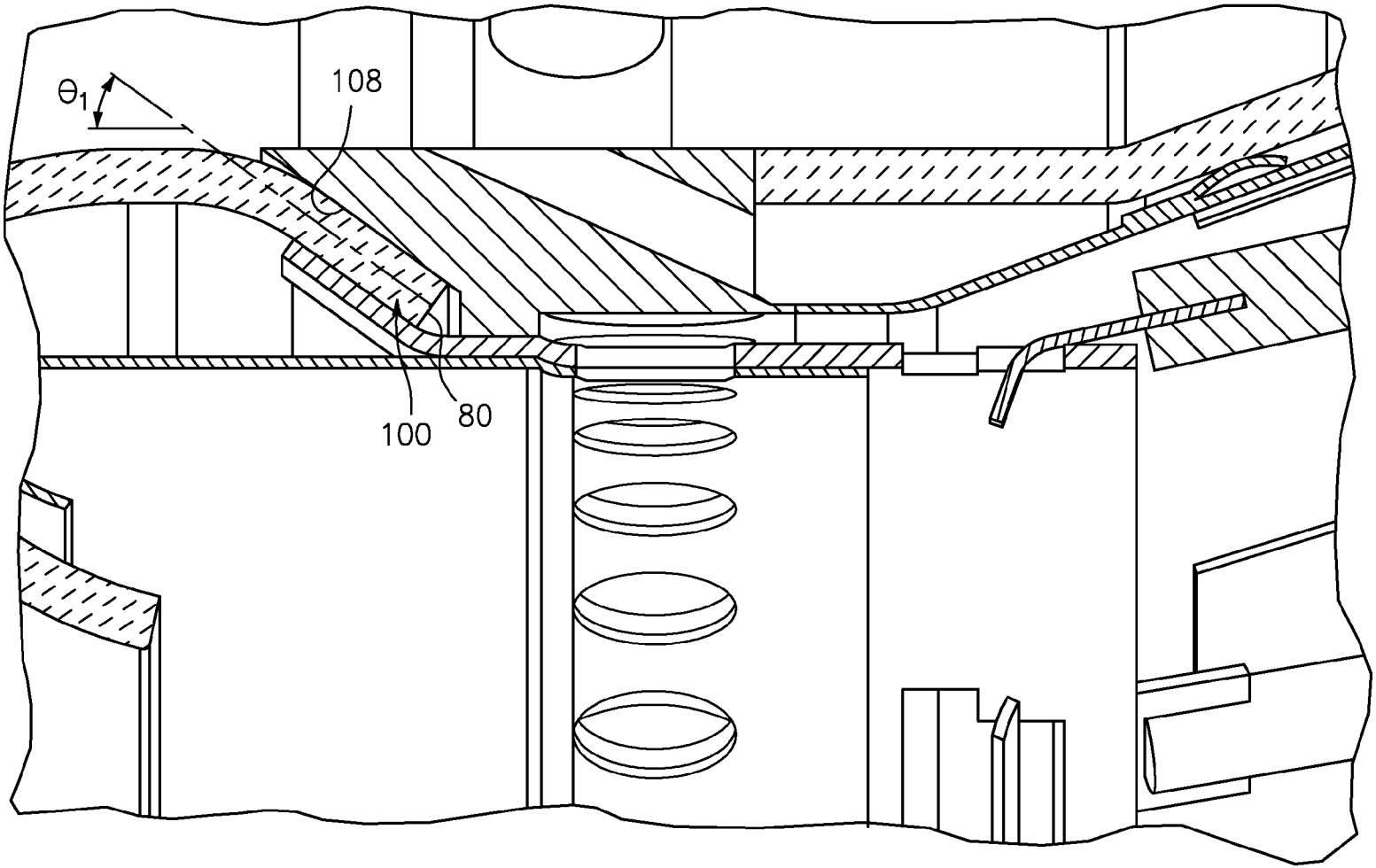
FIG. 5 is a partial enlarged axial/radial sectional view of a second combustor.

FIG. 5 shows an otherwise similar system with hooks penetrating the ring from outboard to inboard (in distinction to inboard-to-outboard).

Figure 6:
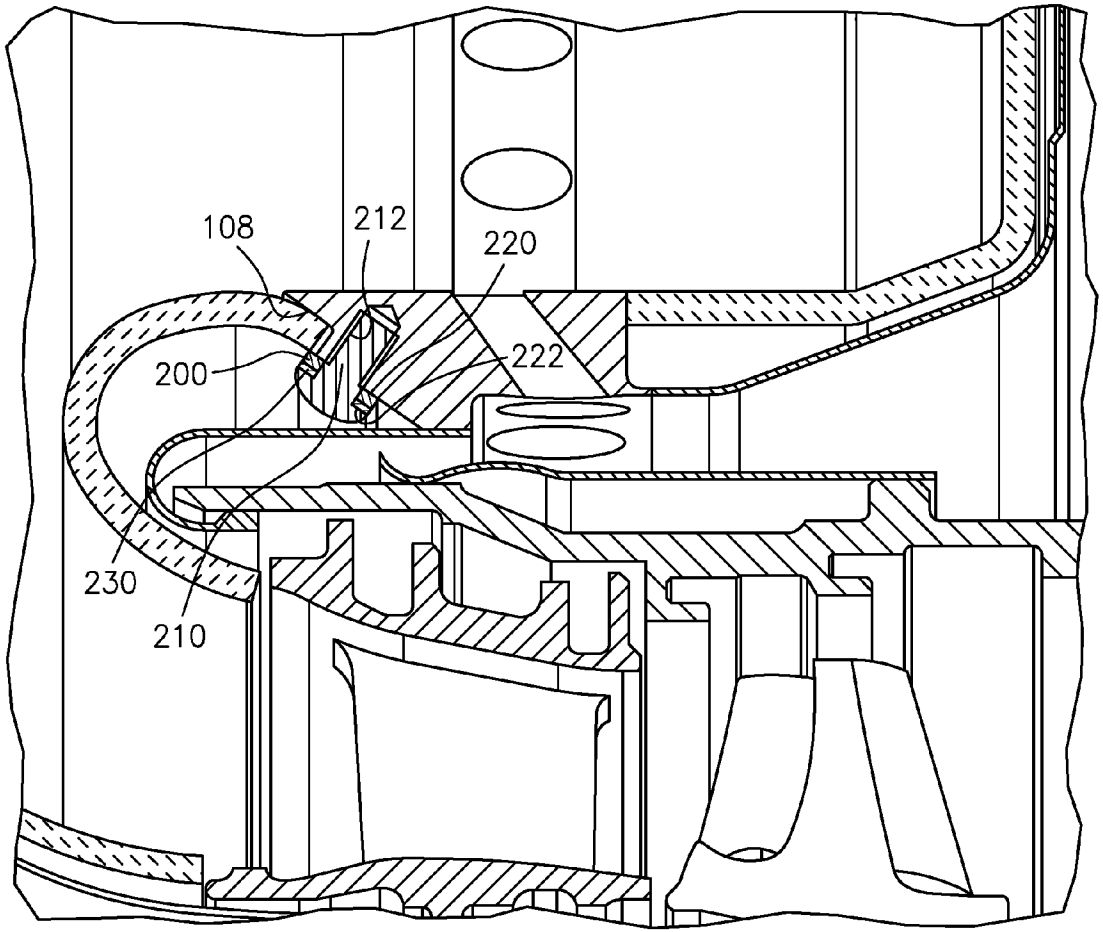
FIG. 6 is an axial/radial sectional view of a third alternate combustor.
Figure 7:
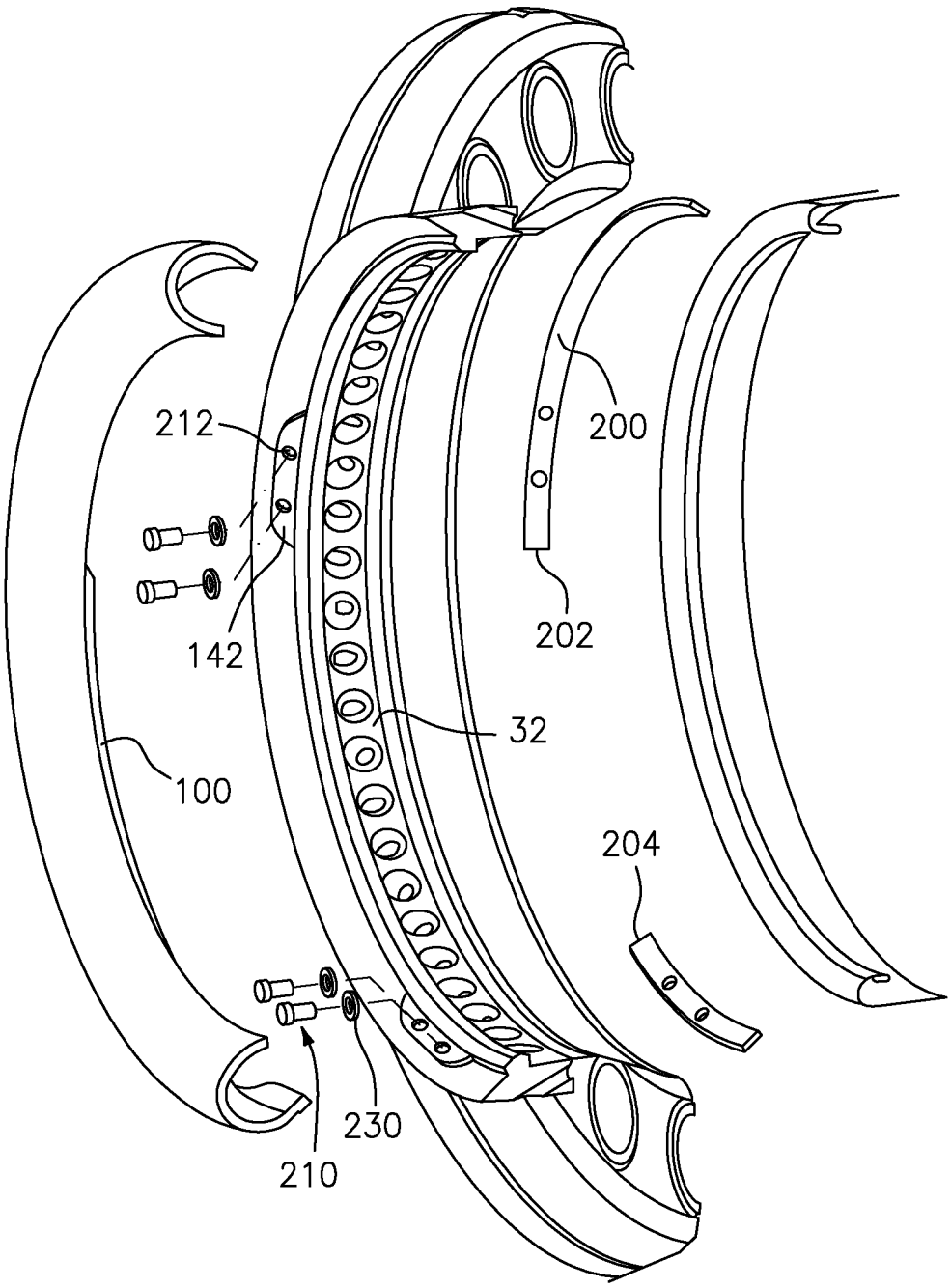
FIG. 7 is a partial exploded view of the combustor of FIG. 6.

FIGS. 6 and 7 show mounting features comprising circumferential straps 200. Each strap extends from a first circumferential end 202 (FIG. 7) to a second circumferential end 204. The exemplary straps are fastened to the inner ring 32 and capture the SED. The exemplary implementation is based upon the SED and ring configuration of the FIG. 2 embodiment with each strap fastened between two adjacent ones of the protrusions 142 (e.g., via screws 210 extending into threaded bores 212 in the protrusions 142). Each exemplary strap 200 thus has a first surface 220 and a second surface 222. The first surface 220 engages the associated protrusions 142 and is held spaced-apart from the remainder of the surface 108 so that intact portions of the region 100 between the recesses 140 in the SED are captured between the surface 220 and the surface 108. Springs such as Bellville washers 230 can be introduced with the bolts to maintain a constant clamp load. In the exemplary implementation, there are 2-10 such straps, more narrowly, an exemplary exactly two such straps.

Figure 8:
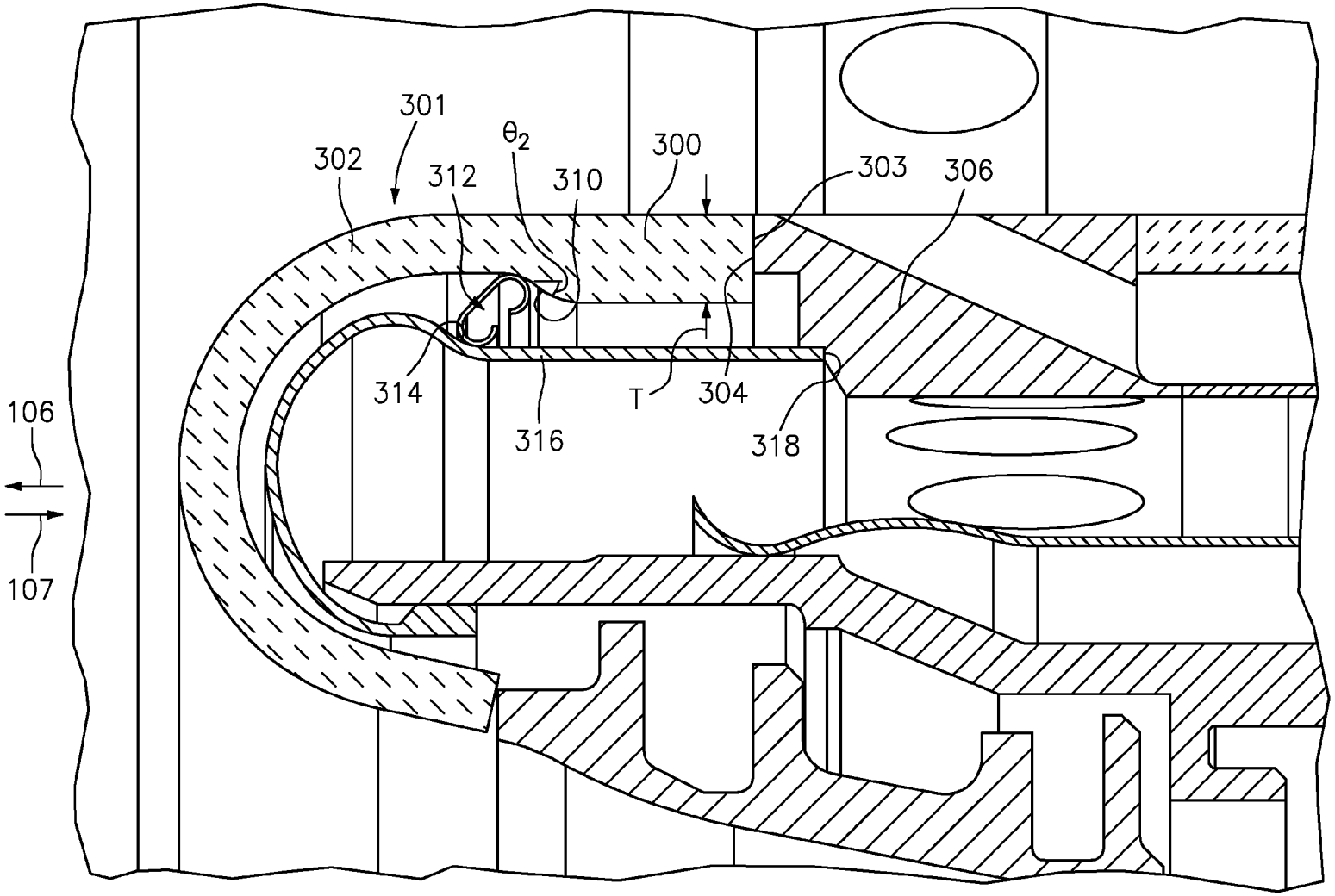
FIG. 8 is a partial axial/radial sectional view of a fourth combustor.

FIG. 8 shows an alternative configuration wherein a leading portion 300 of the SED 301 is relatively thickened compared with a remaining portion 302 (e.g., along the portion 300 the thickness T is at least 150%, more narrowly, 150-250% or 175-225% the thickness along the portion 302). The leading portion extends generally axially to a leading/upstream rim 303. At a junction between the thickened portion 300 and the remainder, a portion 310 of the exterior surface transitions and thus is directed partially radially inward and partially in the direction 106 (e.g., at an angle $\theta_2$ which may be the same size as $\theta_1$). An annular resilient member 312 is captured between this surface and a corresponding surface portion 314 of a liner 316. The liner extends from an upstream rim/end 318 which is secured to the inner ring 306. The surface portion 314 faces partially radially outward and partially opposite the direction 106 to allow capturing of the member 312. An exemplary member 312 is a metallic generally C-sectioned sheetmetal member such as is used as a seal. The exemplary member 312 is a U seal or an Omega seal which compresses to transmit force in both the radial and axial directions. Other types of springs such as canted coil springs can also be employed.

Figure 9:
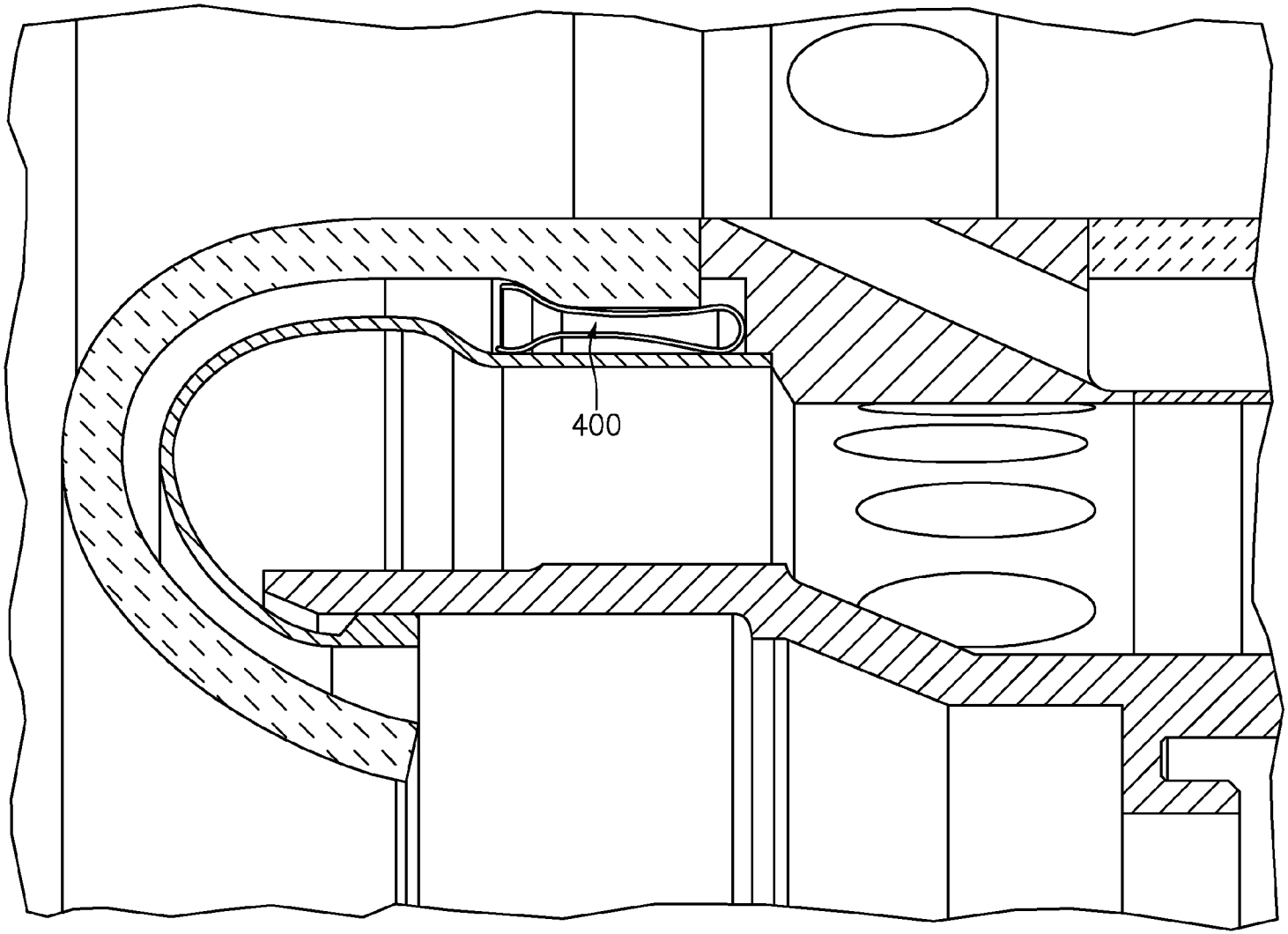
FIG. 9 is a partial axial/radial sectional view of a fifth combustor.

The SED 301 may be installed by a process comprising: 1) sliding the U seal 312 onto the metal baffle plate 316; 2) cooling the assembly of the seal 312 and plate 316 to thermally contract them (e.g., to −40 C); 3) heating the CMC SED 301 to expand it (e.g., to 1000 C); 4) sliding/inserting the cooled assembly of seal 312 and plate 316 into the heated CMC SED 301; and 5) welding the baffle plate 316 to inner air inlet ring 306. Thus, during the inserting, the SED is at a hotter-than-ambient temperature and the assembly is at a cooler-than-ambient temperature FIG. 9 shows an alternate configuration of a similar SED with a resilient member 400 replacing the member 312.

One or more embodiments have been described. Nevertheless, it will be understood that various modifications may be made. For example, when implemented in the remanufacture of the baseline engine or the reengineering of a baseline engine configuration, details of the baseline configuration may influence details of any particular implementation. Accordingly, other embodiments are within the scope of the following claims.

What is claimed is:

1. A reverse flow combustor comprising:

an inlet end;

a flowpath extending downstream from the inlet end through a turn, the turn directing the flowpath radially inward and reversing an axial flow direction a large exit duct (LED) along the turn;

a small exit duct (SED) along the turn and joined by a joint to a mounting structure to resist separation in a first axial direction, the joint comprising:

a first surface on the SED facing partially radially inward; and a mounting feature engaging the first surface at a location on the first surface facing partially radially inward to resest said separation further comprising a metallic clamp ring for engaging said first surface of the Sed, wherein the mounting frature is formed by a plurality of tabs on the metallic clamp ring extending radially outward, and the metallic clamp ring being pulled in the direction opposite from the first axial direction by a plurality of metal bolts.

2. The reverse flow combustor of claim 1 further comprising:

an inlet dome forming the inlet end and having an outboard rim and an inboard rim;

an outer air inlet ring between the dome outboard rim and an upstream rim of the LED; and an inner air inlet ring between the dome inboard rim and an upstream rim of the SED.

3. The reverse flow combustor of claim 2 wherein:

the upstream rim of the SED comprises plurality of recesses; and the inner air inlet ring comprises a plurality of projections received in respective said recesses to rotationally register the SED.

4. The reverse flow combustor of claim 1 wherein:

the SED comprises an upstream region directed radially inwardly toward the upstream rim of the SED.

5. The reverse flow combustor of claim 1 wherein:

the SED comprises a ceramic matrix composite (CMC).

6. The reverse flow combustor of claim 1 wherein:

the first surface is off-axial.

7. The reverse flow combustor of claim 4 wherein:

the first surface is off-axial by an angle of 20-60°.

8. The reverse flow combustor of claim 4 wherein:

the first surface is off-axial by an angle of 30-50°.

9. The reverse flow combustor of claim 1 further comprising:

a ring, a surface of the ring being positioned to engage a second surface of the SED opposite the first surface to resist movement in a direction opposite the first axial direction.

10. The reverse flow combustor of claim 1 wherein:

the first surface is a first surface portion of a leading/upstream portion of the SED directed radially inward toward an upstream rim of the SED.

11. The reverse flow combustor of claim 10 wherein:

the first surface portion and an opposite second surface portion are off-axial by an angle of 20-60°.

12. The reverse flow combustor of claim 2 wherein:

the inner air inlet ring has an angled downstream surface engaging a second surface of the SED opposite the first surface.

* * * * *